US006180925B1

(12) United States Patent
Moore et al.

(10) Patent No.: US 6,180,925 B1
(45) Date of Patent: Jan. 30, 2001

(54) HEATING ELEMENT WITH REGIONS OF HIGH/LOW DENSITY

(75) Inventors: Robin K. Moore, Buxton (GB); Sander Slegt, Leek (NL)

(73) Assignee: U.S. Philips Corporation, New York, NY (US)

( * ) Notice: Under 35 U.S.C. 154(b), the term of this patent shall be extended for 0 days.

(21) Appl. No.: 09/198,933

(22) Filed: Nov. 24, 1998

(30) Foreign Application Priority Data

Nov. 28, 1997 (GB) ..... 9725099

(51) Int. Cl.[7] ..... F27D 11/00

(52) U.S. Cl. ..... 219/441; 219/438; 219/540; 219/548

(58) Field of Search ..... 219/438, 436, 219/437, 540, 523, 543, 544, 548, 441

(56) References Cited

U.S. PATENT DOCUMENTS 5,140,134 * 8/1992 Reusche et al. ..... 219/441
5,693,244 * 12/1997 Pragt et al. ..... 219/441
5,774,627 * 6/1998 Jackson ..... 392/497
5,793,929 * 8/1998 Taylor ..... 392/498

FOREIGN PATENT DOCUMENTS

0715483A2 6/1996 (EP) ..... H05B/1/02
94/18807 8/1994 (WO) ..... H05B/3/82

* cited by examiner

*Primary Examiner*—Teresa Walberg
*Assistant Examiner*—Shawntina Fuqua
(74) *Attorney, Agent, or Firm*—Ernestine C. Bartlett

(57) ABSTRACT

A heating element for a liquid heating vessel, comprises a metal substrate, an insulating layer provided over the substrate, and an electrically conductive heating track provided over the insulating layer. The heating track comprises a path extending between two contact pads, the heating track defining regions of relatively high density of track portions and regions of relatively low density of track portions. The contact pads are located in regions of relatively low density, and the layout of the heating track is designed such that in the event of thermal overheating of the element, the heating track ruptures at one of a predetermined set of locations in high density regions of the heating track. The heating track itself thereby functions as a thermal fuse.

17 Claims, 2 Drawing Sheets

HEATING ELEMENT WITH REGIONS OF HIGH/LOW DENSITY

BACKGROUND OF THE INVENTION

This invention relates to electric heating elements, for example for use in liquid heating vessels, such as kettles, rice cookers, coffee makers, etc. The invention relates particularly to heating elements which comprise an electrically heated conducting track provided over a substantially planar metal substrate.

This type of heating element is increasingly being used in electric kettles, where it provides the advantage that cleaning the inside of the kettle is easier, and it may be possible to boil a small quantity of water, since a smaller quantity of water is required to cover the heating element than is required for conventional immersion elements. Safety requirements dictate that electric kettles require two protection devices to ensure that the electrical supply to the heating element is broken in the event of overheating of the electric kettle (for example if the steam sensitive cut-off switch for boiling fails, or if the kettle is turned on with no water in it). Conventionally, the two overheat protection devices have been integrated into a control unit of the electric kettle, and one or both of these overheat protection devices may comprise a bimetallic switch which switches off when a bimetallic strip reaches a predetermined temperature. Additionally, or alternatively, portions of the control housing may be formed from a plastic which melts at a predetermined temperature so that in the event of failure of all other overheat protection devices, the body of the control housing melts resulting in movement of components causing disconnection of the electrical supply to the heating element. If this melt-down protection is employed, only one thermal protection device in the form of a bimetallic switch may be required.

EP 0 715 483 which corresponds substantially to U.S. Pat. No. 5,793,929, discloses an electric heating element comprising a conductive heating track provided over a substrate, and extending between two contact terminals. The track comprises a first portion which extends around the circumference of the heating element and is an unheated portion of the track. This first portion is connected in series to a second, inner, heating portion of the track. The unheated portion of the track acts as a thermal fuse which breaks the connection between the two contact pads in the event of overheating of the heating element.

SUMMARY OF THE INVENTION

The present invention is based on the realization that the heating track itself may act as a thermal fuse, thereby avoiding the need for additional unheated track portions to be provided to act as a thermal fuse.

According to a first aspect of the present invention, there is provided a heating element for a liquid heating vessel, comprising a metal substrate, an insulating layer provided over the substrate, and an electrically conductive heating track provided over the insulating layer, the heating track comprising a path extending between two contact pads, the heating track defining regions of relatively high density of track portions and regions of relatively low density of track portions, the contact pads being located in regions of relatively low density, and wherein the layout of the heating track is designed such that in the event of thermal overheating of the element, the heating track ruptures at one of a predetermined set of locations in high density regions of the heating track.

In the heating element of the invention, the track layout is designed with regions of high density and regions of low density of track portions, and this gives rise to local hot spots caused by the heating track. Appropriate design of these hot spots enables the position of track rupture in the event of overheating to be selected, so that the heating track can act as a reliable fuse. The position where rupture takes place is important, because this enables the risk of arcing to be minimized, as well as the risk of high current surges during track rupture.

Preferably, the predetermined locations are remote from the contact pads, so that when there is track rupture at the selected location, arcing does not occur from the point of rupture to the contact pads, which could potentially lead to a fire hazard.

In order to limit the level of the current surge which occurs during track rupture, it is desirable for the track rupture to occur towards the middle of the heating track, so that there is a resistive portion of the heating track between the rupture point and each of the contact pads. Thus, irrespectively of the polarity of the voltage applied to the contact pads, there is some resistance in the path from the high voltage (live) contact pad to the point of rupture, and this limits the current surge which occurs during track rupture.

Thus, according to a second aspect of the present invention there is provided a heating element for a liquid heating vessel, comprising a metal substrate, an insulating layer provided over the substrate, and an electrically conductive heating track provided over the insulating layer, the heating track comprising a path extending between two contact pads, the heating track defining regions of relatively high density of track portions and regions of relatively low density of track portions, wherein the contact pads are positioned in a low density region in an inner portion of the heating element, and the portions of the heating track leading directly from the two contact pads each extend radially outwardly through a low density region to an outer portion of the heating element, and then follow a path which progresses towards the center of the element.

It has been found that the point of rupture of the heating track occurs at a point of the heating track in which local hot spot conditions are present as well as a high voltage. Consequently, when the heating track portion extends from the contact pads to a periphery of the heating element through a low density region of the element, rupturing of the heating track in portions of the heating track adjacent the contact pads is avoided. Thus, the maximum current surge upon rupturing can be reduced. Furthermore, when the heating track follows a path which progresses towards the center of the elements, multiple ruptures which can occur will progress outwardly towards a cooler portion of the heating element and thus die out.

A region of relatively high density of track portions preferably comprises a region where there are more than two heating track portions in close proximity to and substantially parallel to each other.

The invention also provides an electric kettle including a heating element of the invention. The electric kettle may comprise a single overheat control device so that the heating track itself and the overheat control device together provide two levels of overheat protection.

BRIEF DESCRIPTION OF THE DRAWINGS

The invention will now be described by way of example, with reference to and as shown in the accompanying drawings, in which.

DESCRIPTION OF THE PREFERRED EMBODIMENTS

Figure 1:
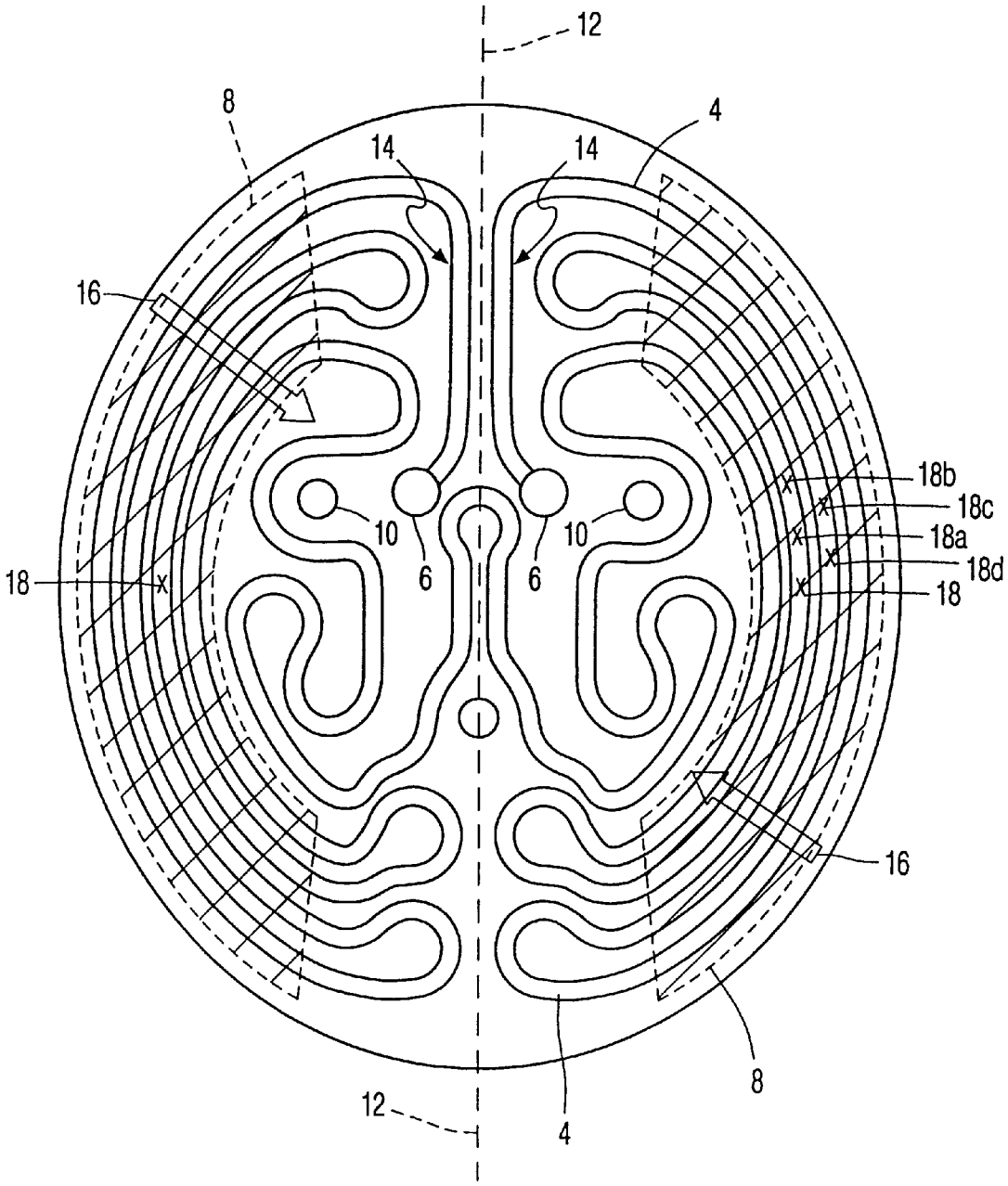
FIG. 1 shows the track configuration of a heating element in accordance with the invention.

FIG. 1 shows in plan view a heating element according to the invention. Although the construction is not shown in detail, the heating element comprises a substrate over which there is provided an insulating dielectric layer and an electrically resistive heating track 4 on the insulating layer.

The substrate comprises a plate of heat conducting material, such as steel or stainless steel. Stainless steel is preferred because the anticorrosion benefits are useful for water heating applications. The substrate is generally formed as a planar sheet of metal and may have any suitable shape. The insulating layer, which is formed over the substrate, may for example comprise a glass ceramic or a porcelain enamel material. According to the coating selected, application may be by printing, spraying or dipping. The skilled addressee will appreciate that various dielectric compositions may be selected, and that various appropriate techniques are available for forming the insulating layer.

The heating track 4 is formed on the insulating layer using a thick film technique, and comprises a resistive path connected between two terminals 6.

The invention is based on the realization that the heating track may function as an overheat protection device, if the layout of the track can be designed to provide a reliable fuse. This enables the heating track layout to replace one of the thermal overheat protection devices which may otherwise be required for safety considerations.

Various factors influence the manner in which the heating track ruptures during sever overheating, and these factors must be taken into consideration when designing the heating track layout.

It has been found by the inventors that for a particular track configuration, fusing of the heating track (which takes place when all other overheat protection devices are disabled) always takes place at one or more identifiable locations. It has been found that track rupturing occurs in regions of the heating element where local hot spots occur and within those hot spots the track to rupture will be that with the greatest voltage applied to it. One of the contact pads 6 of the heating track 4 is connected to a live terminal, and the other is connected to a neutral terminal. Thus, within a hot spot of the heating element the track which is closest to the live terminal will be the first to rupture. During rupturing of a track, a blow hole appears through the heating track and current can temporarily pass from the heating track through to the metal substrate beneath. Thus, the blow holes causing rupturing of the heating track occur during a current surge.

If the fusing of the heating track is to act as an overheat protection device, it is required that activation of the overheat device does not result in breakage of any external fuses, including the plug fuse and any fuses in the mains domestic circuit. It is therefore necessary to control the current surge which occurs during track rupture in order to limit the peak surge current as well as the time over which the current surge takes place.

If the hot spot occurs adjacent earth points of the heating elements or adjacent the contact pads 6 the track may rupture by arcing between the earth points or the contact pads and the closest track in the hot spot. This provides less predictable fusing action which can result in greater surge currents.

The track configuration shown in FIG. 1 has been designed with the above considerations in mind, as will be explained in the following description.

As described above, the heating track 4 comprises a path extending between two contact pads 6. The arrangement of the heating track results in different areas of the substrate having different density of heating track paths. For example, in FIG. 1 the regions 8 may be considered to be regions of relatively high density of track portions, and the remainder of the heating element may be considered as a region of relatively low density of track portions. In this respect, a region of high density may be defined as one having more than two heating track portions running substantially parallel to each other and in close proximity to each other. However, for the purposes of the invention, all that is required is that selected regions of the element are more densely populated by heating track portion than other regions, so that hot spots will occur over predefined portions of the heating element substrate.

The heating track shown in FIG. 1 comprises the two contact pads 6, and the mains connections to the heating track are via these contact pads through an appropriate control unit. Connections of the control unit to the heating element are also shown as earth points 10. The contact pads 6 and the earth points 10 are each located in the low density region of the heating element. These terminals are therefore spaced from the hot spots of the heating element.

As explained above, it is desirable that the track rupture occurs at some distance from the contact pad 6, so that there is some resistance between the point of rupture and the live terminal (which may be one or other of the contact pads 6). In certain countries it is not possible to define which contact pad 6 is connected to live and which is connected to neutral, as a result of the reversible plug socket. Consequently, it is required that the rupture point should occur at some distance along the heating track from either contact terminal 6, and this gives rise to the preferred feature that the heating track configuration is symmetrical about the line of equal distance from the two contact terminals (the vertical line 12 in FIG. 1).

To ensure that track rupture does not occur only a short distance along the heating track from the contact pad 6, the track portions 14 leading immediately from the contact pads 6 extend through a low density region to the periphery of the heating element which in use of the element is a relatively cool area. The heating track portions then follow a path inwardly as represented by arrows 16 in the high density regions 8.

The track configuration as shown in FIG. 1 ruptures during an overheat test approximately at one of the points 18 (depending upon the polarity of the contact pads 6). Thus, the heating track configuration ensures that there is some heating track between the live terminal and the point of rupture, so that the maximum current flowing through the blow hole (the point of rupture) to the substrate is controlled.

It has also been found that after an initial rupture of the heating track, a second and further ruptures can take place progressing along the heating track towards the live terminal. This occurs because although after an initial rupture no current can flow between the contact pads 6 along the heating track 4, the hot spot of the heating element is still present, and the heating element may still be increasing in temperature as a result of the heat stored in the heating track.

A further blow hole may therefore appear at a higher voltage point along the heating track. This can give rise to a sequence of blow holes indicated as 18*a,* 18*b,* 18*c,* 18*d* appearing in that order. In each case the blow hole progresses towards the live contact terminal, and can skip across track portions, as shown. As a result of the inward progression of the heating track represented by arrows 16, these blow holes progress outwardly towards the outer periphery of the heating element. Since the outer periphery of the heating element is a lower temperature area of the element, at some point the ruptures will reach the edge of the hot spot, and the combination of voltage and temperature is no longer sufficient to create track rupture. Consequently, the blow holes die out with time.

This has been found to be an important consideration because if a great number of blow holes are allowed to appear in succession this can give rise to a large current surge sufficient to blow a plug fuse. The track configuration of the invention ensures that any succession of blow holes dies out with time thereby limiting the current surge occurring during thermal overheating.

The thermal heat distribution caused by any particular track configuration can be examined using thermal imaging techniques when applying a voltage to the heating track while disabling other overheat protection devices. This enables the rupture point for a track configuration to be predicted accurately.

Figure 2:
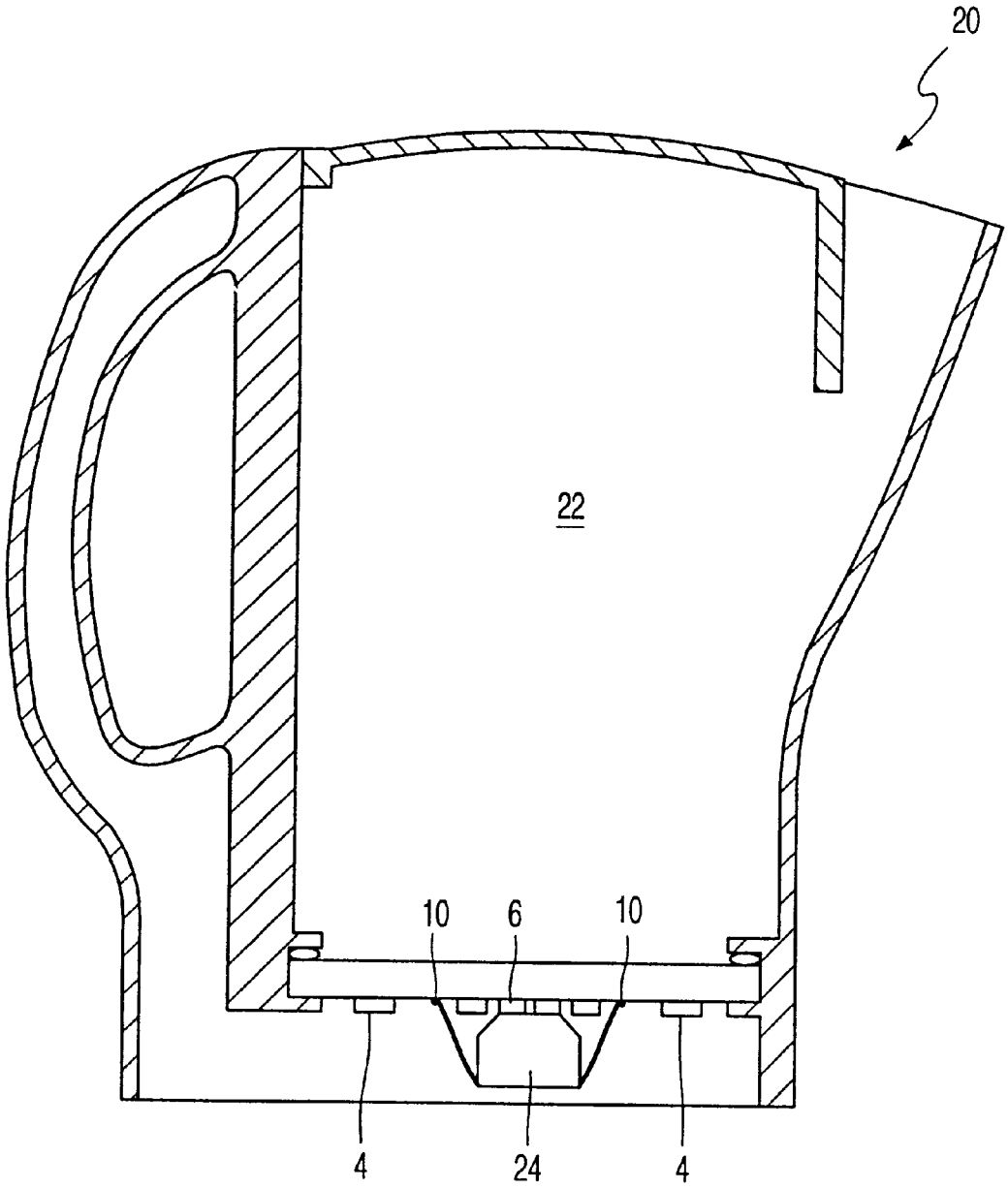
FIG. 2 shows an electric kettle incorporating a heating element of the invention.

The heating element of the invention may be applied to various heating vessels, but as one preferred example FIG. 2 shows an electric kettle incorporating a heating element of the invention.

In conventional manner, the heating element is suspended in the base of the kettle 20 with the heating track 4 facing downwardly. During operation of the kettle, heat is transferred from the heating track 4 through the insulating layer and the substrate into the body 22 of the kettle 20. The kettle 20 includes a control unit 24 connected at the earth point 10 and making electrical contact with the contact pads 6. The control unit 24 may include a cordless or conventional connector and may include one or more thermal overheat protection devices. Even if only one thermal overheat protection device is included in the control unit 24, double protection is obtained by virtue of the thermal fusing action of the heating track itself.

What is claimed is:

1. A heating element for a liquid heating vessel comprising a metal substrate, an insulating layer provided over the substrate, and an electrically conductive heating track provided over the insulating layer, the heating track comprising a path extending between two contact pads, the heating track defining regions of relatively high density of track portions and regions of relatively low density of track portions, the contact pads being located in regions of relatively low density of track portions, and wherein the layout of the heating track is designed such that in the event of thermal overheating of the element, the heating track ruptures at one or more of predetermined locations in high density regions of track portions of the heating track, which locations are remote from the contact pads.

2. A heating element for a liquid heating vessel, comprising a metal substrate, an insulating layer provided over the substrate, and an electrically conductive heating track provided over the insulating layer, the heating track comprising a path extending between two contact pads, the heating track defining regions of relatively high density of track portions and regions of relatively low density of track portions, wherein the contact pads are positioned in a low density region in an inner portion of the heating element, and the portions of the heating track leading directly from the two contact pads each extend radially outwardly through a low density region to an outer portion of the heating element, and then follow a path which progresses towards the center of the element, wherein the layout of the heating track is designed such that in the event of thermal overheating of the element, the heating track ruptures at one or more predetermined locations in high density regions of the heating track.

3. A heating element as claimed in claim 1, wherein a region of relatively high density of track portions comprises a region where there are more than two heating track portions in substantially parallel positions relative to each other.

4. A heating element as claimed in claim 1, further comprising a control element coupled to the contact pads, and having earth connections to the element, the earth connections being located in the inner portion of the element and in a low density region.

5. An electric kettle including a heating element as claimed in claim 1.

6. An electric kettle as claimed in claim 5, comprising a single overheat control device, the overheat device and the heating track thereby providing two levels of overheat protection.

7. A heating element for a liquid heating vessel, comprising a metal substrate, an insulating layer provided over the substrate, and an electrically conductive heating track provided over the insulating layer, the heating track comprising a path extending between two contact pads, the heating track defining regions of relatively high density of track portions and regions of relatively low density of track portions, the contact pads being located in regions of relatively low density, and wherein the layout of the heating track is designed such that in the event of thermal overheating of the element, the heating track ruptures at one or more of a predetermined set of locations in high density regions of the heating track, which locations are remote from the contact pads.

8. A heating element for a liquid heating vessel, comprising a metal substrate, an insulating layer provided over the substrate, and an electrically conductive heating track provided over the insulating layer, the heating track comprising a path extending between two contact pads, the heating track defining regions of relatively high density of track portions and regions of relatively low density of track portions, the contact pads being located in regions of relatively low density, and wherein the layout of the heating track is designed such that in the event of thermal overheating of the element, the heating track ruptures at one or more of a predetermined set of locations in high density regions of the heating track, which locations are remote from the contact pads, wherein the heating track is designed so that in the event of a sequence of ruptures occurring during overheating, these progress in time towards a cooler portion of the element.

9. A heating element as claimed in claim 7, further comprising a control element coupled to the contact pads, and having earth connections to the element, the earth connections being located in the inner portion of the element and in a low density region.

10. An electric kettle including a heating element as claimed in claim 7.

11. An electric kettle as claimed in claim 10, comprising a single overheat control device, the overheat device and the heating track thereby providing two levels of overheat protection.

12. A heating element as claimed in claim 8, further comprising a control element coupled to the contact pads, and having earth connections to the element, the earth connections being located in the inner portion of the element and in a low density region.

13. An electric kettle including a heating element as claimed in claim 8.

14. An electric kettle as claimed in claim 13, comprising a single overheat control device, the overheat device and the heating track thereby providing two levels of overheat protection.

15. A heating element as claimed in claim 2, further comprising a control element coupled to the contact pads, and having earth connections to the element, the earth connections being located in the inner portion of the element and in a low density region.

16. An electric kettle including a heating element as claimed in claim 4.

17. An electric kettle as claimed in claim 16, comprising a single overheat control device, the overheat device and the heating track thereby providing two levels of overheat protection.

* * * * *